US005080137A

United States Patent [19]

Adams

[11] Patent Number: 5,080,137

[45] Date of Patent: Jan. 14, 1992

[54] VORTEX FLOW REGULATORS FOR STORM SEWER CATCH BASINS

[76] Inventor: Thomas R. Adams, c/o Voretehnics, Ste. 420, 477 Congress St., Portland, Me. 04101

[21] Appl. No.: 624,356

[22] Filed: Dec. 7, 1990

[51] Int. Cl.[5] ..... F15C 1/16

[52] U.S. Cl. ..... 137/810; 137/813; 137/329.01; 137/315

[58] Field of Search ..... 137/810, 813, 329.01, 137/315

[56] References Cited

U.S. PATENT DOCUMENTS 3,084,712 4/1963 Brown ..... 137/564.5
4,206,783 6/1980 Brombach ..... 137/810
4,679,595 7/1987 Johannessen ..... 137/813
4,889,166 12/1989 Lakatos ..... 137/810

*Primary Examiner*—A. Michael Chambers
*Attorney, Agent, or Firm*—Laforest S. Saulsbury

[57] ABSTRACT

A vortex flow regulator used in sewer catch basins to prevent overflow of the system from storm water run-off and to standardize the production of regulators. The hollow body of these flow regulators within a given range of regulators by the present construction have been found suitable for different size discharge orifice requirements. A flow regulator has been provided that is adapted to standardization of parts when built with only its discharge orifice needing change. The structure lends itself to mass production of flow regulators. Simple means for attachment of flow regulators within basin drain pipes has been provided.

3 Claims, 4 Drawing Sheets

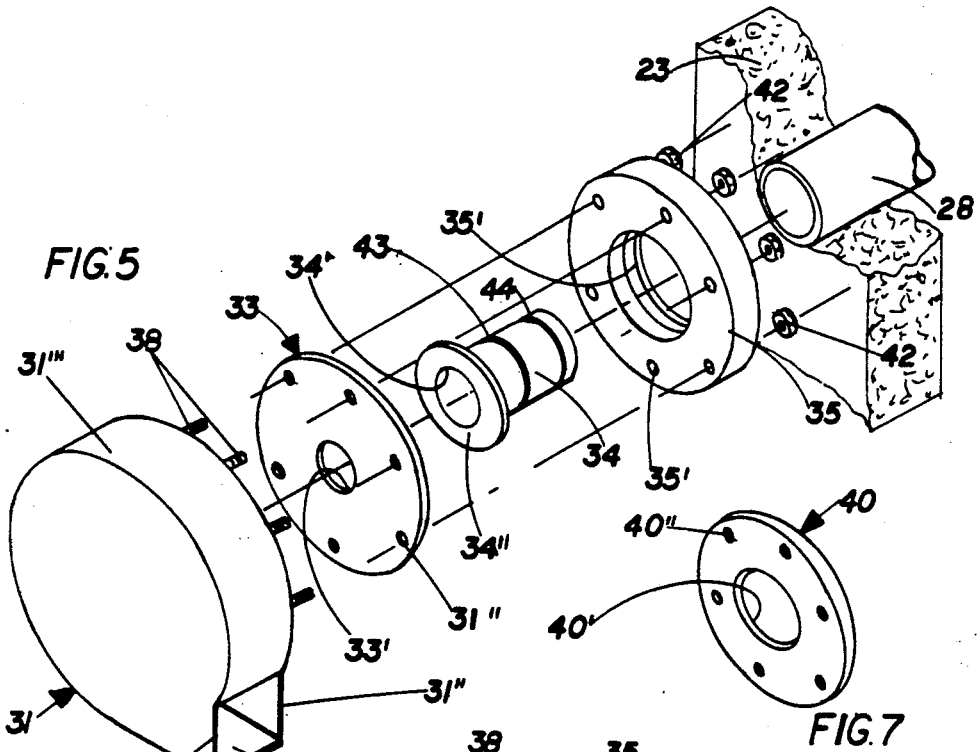
FIG. 5
23
42
28
35'
43
34'
44
33
38
31'''
42
35
34
35'
34''
31''
33'
31''
31'
32
31'
40
40''
40'
FIG. 7
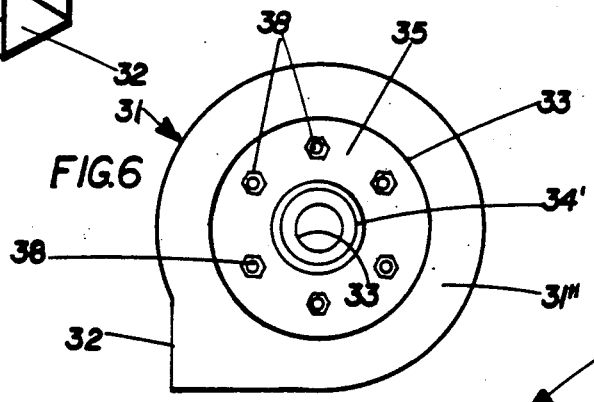
38
35
33
31
FIG. 6
34'
38
33
31'''
32
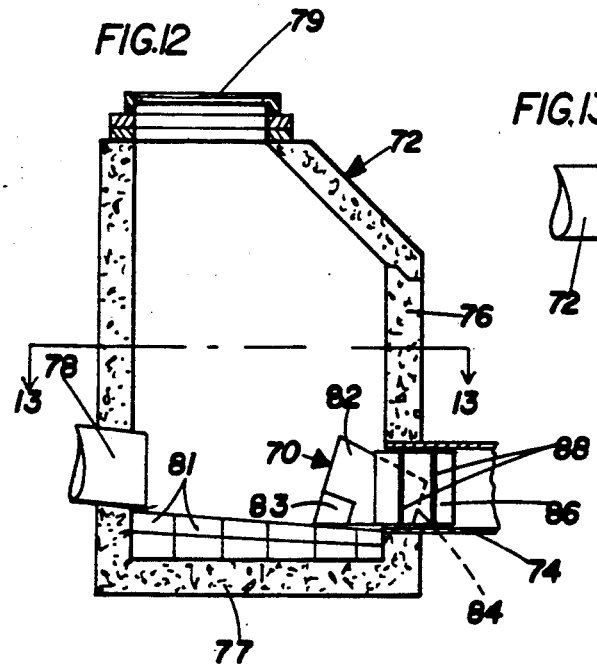
FIG. 12
79
72
76
78
13
13
82
70
88
81
83
86
74
84
77
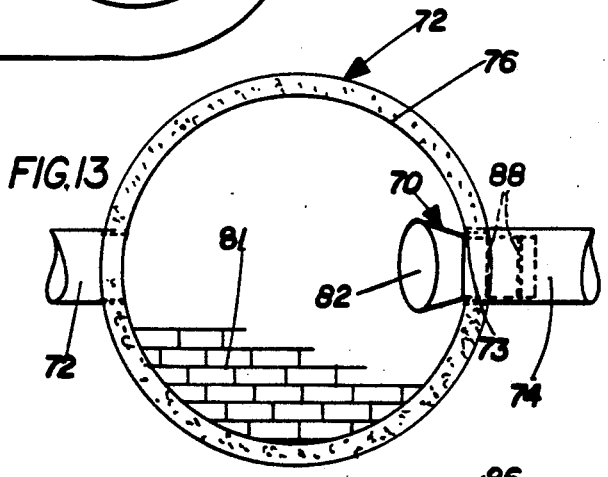
FIG. 13
72
76
70
88
81
82
72
73
74
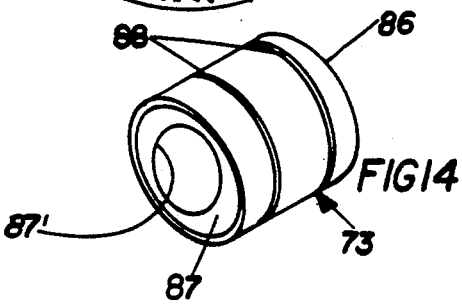
88
86
FIG 14
87'
73
87

VORTEX FLOW REGULATORS FOR STORM SEWER CATCH BASINS

This invention relates to vortex flow regulators used in sewers and catch basins to prevent overflow from storm water runoff and to standardized production of the same.

The general principle on which vortex flow regulators work is likened to hand throttling valves normally used, and with no moving parts but automatic of themselves in operation and without need of hand adjustment. These vortex regulators are installed in the outlet pipe of storm sewers and catch basins and are responsive to increase in rate of flow from sewers resulting from a build-up of storm water runoff. The flow from the sewers is amplified as it is suddenly being filled and works without need of mechanical operative adjustment at the time of the storm to hold back flow. The structure of the vortex flow regulator or amplifier is generally of annular shape with a tangential inlet opening that causes a vortex of the liquid flow inside and a whirl about its central axis of its hollow body. Such a device is well suited to cope with flows of storm water, that vary widely in the rate of flow and large solid matter that would ordinarily clog a non-vortexing, plug flow, throttling valve.

The energy of the water rushing into the flow regulator develops a vortex spiral action to dissipate the rate of flow from this sewer with increases in flow to the catch basin or manhole where it is installed. The vortex regulator housing body is of spiral shape so that water pouring into its chamber is circulated around and around therewithin. Thus, sewer outlet lines are not burdened or clogged as a result of a sudden storm runoff and much of the water will be kept back in normally unfilled sewers or diverted to an alternate flow path. The velocity of the water caught in the vortex is so high that debris is pulled through with tremendous force and clogging of the sewer is further minimized.

The spiral flow path approaches the outlet tangentially. Still spiralling, or vortexing, when it reaches the edge of the outlet orifice, it leaves the housing by flowing over the edge of the outlet. The central portion of the outlet orifice remains dry and passes no water. Throttling is effected by having only a thin band around the perimeter of the outlet orifice actually passes the water. Openings large enough to pass debris associated with stormwater runoff will still limit flows to rates normally associated with much smaller openings.

Backup problems of downstream sewers have been solved with the use of these vortex flow regulators. They have proved effective in relieving municipal combined sewer overflow and back-up problems.

Because of the complicated and elaborate extent of design such flow regulators have been costly to make and delivery time prolonged. Such structures have been individually sized each particular size of sewer basins in which installation is to be made with the result that each unit has had to be custom made with overriding expense and delay of delivery time. Several different units for the different size capacity of sewer basins have been required with no effort to provide a qualified single styling is a single unit that could be adapted to any of several different size sewers. Vortex regulators have also become commonly known as hydro-brakes.

In the U.S. Pat. No. 4,206,783, there is shown a vortex chamber valve that is funnel-shaped like a cone, and it lies on its side. In use, a vortex flow of water is formed therein to brake the flow rate of water leaving the sewer in response to increase with the volume and head of the storm water taken into the sewer and, will lessen as the head lowers thus operating upon the vortex flow principle. The cone part of the valve lies on its side flush with the bottom of the sewer basin and the reduced discharge end is installed in the wall drain outlet pipe adjacent to the sewer bottom. A venting port is used in connection with the patented chamber valve with a feed line that extends from above the sewer head level to the highest point in its chamber while a tangential inlet for the water flow into the chamber is disposed in the vicinity of the largest cross-sectional area of the chamber adjacent to the sewer bottom. As the valve rests upon the bottom, its longitudinal axis assumes an angle of 30 degrees to the vertical. Such valve operates without moving parts, free from wear and maintenance. They are very reliable, and will handle much coarse contaminate matter and solids. The spiralling centrifugal force at the nozzle outlet greatly constricts the flow therethrough. The construction of the patented form of U.S. Pat. No. 4,206,783 has been complicated because of the need for diffuse type nozzle and not making for a construction that can be readily installed in an ordinary catch basin drain pipe with its vent pipe.

In prior installations, vortex type catch basin flow regulator dimensions are variable as to flow and head change and each vortex regulator has had to be custom made for each individual catch basin. When the outlet was changed, the inlet size had to be changed and, the overall basic body structure had to be re-dimensioned. All dimensions had to be adjusted to the desired flow and head changes. The prior regulators have thus required size changes in height, width, inlet opening as well as change in the discharge outlet orifice.

It is the principal object of the present invention to provide a vortex catch basin flow regulator that will be of a construction suitable for mass production, simple and without need for numerous dimensional changes or extraneous portions and gadgetry for their operation.

It is another object of the invention to provide a single-shaped construction that can be easily adapted for several size outlet requirements by simple alteration of the outlet orifice and nozzle structure, while permitting this basic structure to be retained without change.

Further objects of the invention are to provide a vortex catch basin flow regulator, with the above objects in mind, which is of simple construction, has a minimum number of parts, no moving part B, inexpensive to manufacture, rugged, easy to alter for installation and easy to install in the sewer basin, effective, efficient and automatic in operation.

It has been found that in the design of vortex regulators basic parts can be used for a wide range of sizes which need not be changed or styled differently for a different performance requirement but rather matched to a mere change of the size of its outlet hole. This has been done by providing a detachable, or alterable, outlet means for the basic structure that allows the outlet hole size to be changed. A plate with one size orifice may be replaced by a plate with a different size orifice. By having a series of plates with different size orifices, any vortex regulator can be changed without need for a complete new design.

A funnel-shaped design has been found adaptable through a range of dimensions useable with conventional sizes with need only to cut the outlet size from the tapered small end of the funnel. A formula is proposed by which the size of the design when taken with an established discharge coefficient determined from much previous testing will provide the needed outlet size. A cut to size is made upon the funnel and the flow regulator is made ready for any given installation. The formula is simply the same as the one used by hydro-brake engineers with the design of vortex regulators. It is also the formula in common use for calculating flow through an orifice.

The formula is based on theory, but has one empirical parameter which is the discharge coefficient $C_d$. This coefficient would be 1.00 if the liquid could flow through the device in question unimpeded by frictional losses of energy and O if no flow could pass through the device. A typical range of $C_d$ for vortex regulators is 0.15–0.35.

The invention has provided a way to test for the $C_d$ of a range of outlet opening diameters so that one size regulator can meet a range of performance requirements by varying the outlet diameter.

To provide proper flow regulation for any given catch basin the required flow discharge rate must be determined, the head depth above regulation and the type of application, that is, whether for a manhole or catch basin. Manhole or catch basin details and dimensions should be known.

Communities suffer from backup problems. When the sewage system is combined with storm water overall. Chronicle floot areas result and relief sewers and tunnels are costly to add to such systems. The best solution is the use of flow regulators in catch basins, underground tanks or on surface for slow release into the system. Disconnecting dwelling downspouts and/or installation of restrictions in them can help.

There is even increasing urban flooding with the event of new buildings, wider roads, bigger car parks all reduce natural drainage causing solid run off of storm water which cannot be handled in existing sewers. A hazard to health and property damage results from sewage overflows. To handle overflows involves high costs, long periods of traffic disruption and inconvenience to the community. These problems are solved by vortex flow regulators with the old sewer systems using existing pipes, less labor and without need for more conventional sewers or deep tunnels.

Without control, water flows rapidly into the main sewer systems which can quickly become overloaded and pressureized. With vortex flow regulators, water is fed at a controlled rate into the system so that the design capacity of sewer system will not be exceeded.

Temporary water storage first takes place within the existing sewer system, the pipes, manholes, gullies, etc. Such capacity may be supplemented by underground wells fed by gullies and connected to existing sewers. For more frequent storms, car parks may be used for controlling the flow. These flow regulators are automatic in operation and ensure that the maximum flow entering the drainage system never exceeds capacity to avoid backup in the system and flooding from drains.

The flow regulators have no moving parts, consume no energy, require no monitoring or care, need little maintenance and last virtually indefinitely. Its configuration with tangential inlet creates centrifugal like motion to the fluid and reduces the rate of flow whatever the head pressure may be. The discharge rate is less than through an open orifice. The liquid spirals with a predetermined flow as soon as the pressure is applied. The sizes and numbers of units are determined by the specific requirements of the system. With the regulators no new sewage capacity is needed. The problem is thus cured without major alterations, where new sewers may be added only small diameter drain pipes are needed or required. New systems may be designed altogether with the use of regulators and with zero increase of run off, shore land often washed away will be made available for new buildings that could not otherwise be developed.

Combined storm and sanitary systems have sewer back-ups in basements, sewer overflows which pollute surface waters, manhole blow off of the covers causing unsafe driving conditions and flows of sewage on street surfaces and an accelerated structural deterioration of the sewer problem.

Storm sewers separate of sanitary ones discharge animal wastes, sand, salt, grease, oil, asbestos from broken linings, lead from gasoline and all forms of debris with flush runoff of a storm.

The rivers and streams receiving all this matter, damages property and when overflowing their banks causes erosion, and deposits, sediment to the detriment of agriculture, navigation, and other ventures. No floatables ever reach the sewage system and are left upon the ground surface for pick up. Thus, the need for effective and inexpensive equipment and mass production of the present vortex flow regulator should be apparent.

For a better understanding of the invention, reference may be had to the following detailed description taken in connection with the accompanying drawing, in which:

FIG. 5 is an exploded view of the flow regulator of FIG. 1 with the parts thereof shown in perspective.

FIG. 6 is an elevational view of the assembled flow regulator of FIG. 1 and looking in the vortex body and upon one orifice disc assembly thereon.

FIG. 7 is a perspective view of another size orifice disc that may replace the one size orifice disc of FIGS. 5 and 6.

FIG. 14 is a perspective view of the attaching sleeve with an oval opening plate to accommodate the tapered regulator in its tilted position and on its side in the basin outlet drain pipe.

Figure 1:
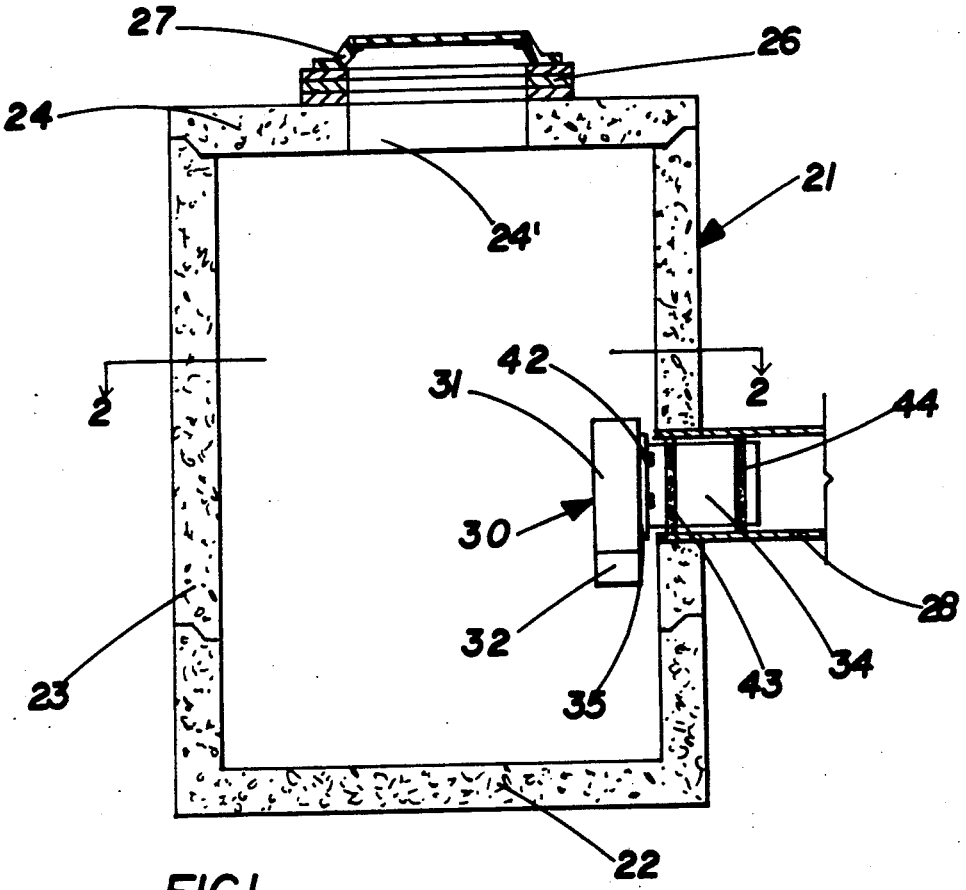
FIG. 1 is a vertical sectional view of a stormwater runoff catch basin and with a vortex flow regulator according to one form of the invention installed in the drain outlet pipe thereof.
Figure 2:
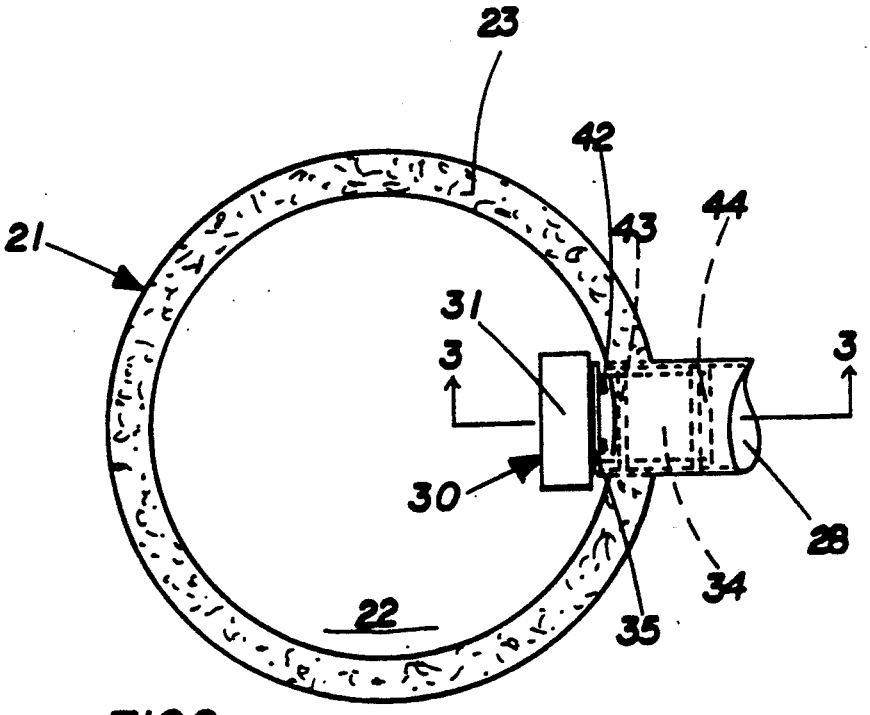
FIG. 2 is a transverse sectional view of the catch basin, taken generally on line 2—2 of FIG. 1 and looking upon the top of the regulator.
Figure 3:
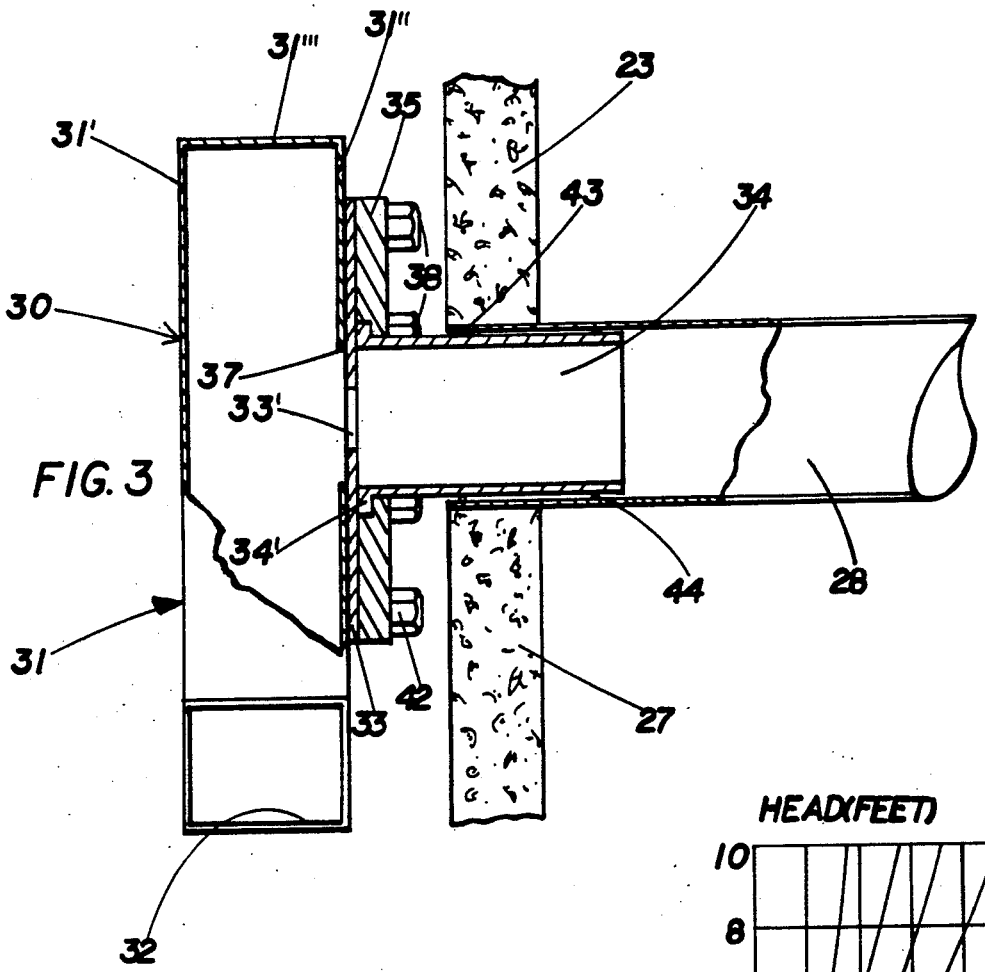
FIG. 3 is an enlarged fragmentary longitudinal sectional view of the flow regulator, taken generally on line 3—3 of FIG. 2 and showing the interior construction thereof.

All of these vortex regulators can be installed in catch basin or manhole outlet pipes by simple attaching devices. It is literally a throttle valve with no moving parts and needs no attention once sized and installed. It is generally annular in shape and has a tangential inlet which causes a vortex to form inside and whirl about a central axis. These vortex regulators are well suited for large flows of storm water that carry large solids which ordinarily clog other throttle valves used in sewer and drainage systems.

The equation that has been used for the sizing of hydro-brakes is identical to the equation which is used for the sizing of an orifice and which is familiar to most civil/hydraulic engineers.

That equation is:

$$Q = C_d A \sqrt{2gH}$$

where

Q=flow rate in cubic feet per second (CFS)

$C_d$=discharge coefficient, (dimensionless)

A=cross-section area of the outlet of the hydro-brake, or orifice, in the square feet.

g=gravitational constant=32.2 feet/second/second

H=hydraulic head, generally in terms of depth of water above the outlet, in feet.

The existing hydro-brake technology is based on this formula and the premise that, for a given hydro-brake configuration, the discharge coefficient, $C_d$, remains constant for all sizes as long as all proportions also remain. Through experimentation, it has been determined that the size of the orifice or outlet diameter is inversely proportional to the discharge coefficient $C_d$. One single housing size can function over a variety of performance characteristics by merely varying the outlet diameter and holding all other dimensions constant. The use of this concept is in accordance with this invention, and makes for mass production of hydraulic brake type flow regulators which have heretofore only been available from a custom manufacturer with need for complete fabrication for each installation.

In the case of an orifice, the $C_d$ is constant for a wide range of sizes, the value of $C_d$ being typically 0.6 plus or minus 10% depending on shape and orientation.

Through experimentation with vortex flow regulators, it has been determined that the value of the discharge coefficient, $C_d$, decreases with increasing outlet size, but that the product of $C_d$ times A always increases as the outlet diameter, and area increases. The range of values of discharge coefficients, $C_d$, is typically between 0.15 and 0.35.

For convenience a chart of work curves has been developed to which referral may be made to obtain the diameter in inches that will be required for a desired discharge outlet flow in cubic feet per second and a given basin head in feet. From any of the curves, the diameter in inches of the orifice size is easily read and determined. Thus, it becomes only necessary to alter this orifice outlet size of a standard regulator without having to build a complete new regulator. Thus, a procedure of standardizing manufacture of flow regulators for storm water catch basins has been effected as will become more apparent with follow-up of detail description of the forms of this invention and novel means extending from the regulator outlet for tight-fitting engagement within the basin outlet drain pipe.

DETAIL DESCRIPTION

Referring now to the first form of the invention as shown in FIGS. 1 to 7, inclusive, 21 represents a catch basin for collecting storm water and built from cylindrical sections of concrete. This catch basin 21 includes a bottom section 22 and a cylindrical wall section rising therefrom to combine with other wall section or sections to provide a wall 23 and a top section 24 at the ground surface having a top opening 24' extending upwardly from the top section 24. There is a series of top rings 26 over which is a grated cover 27 for the passage of storm water from ground level into the catch basin 21. Such catch basins have an outlet drain pipe 28 that feed into a municipal sewer system along with household sewer basins from their drain pipes and into which sewage may back up from storms that overload the system. Thus, vortex flow regulators, commonly call hydro-brakes, are installed in storm water catch basins so that drainage from these basins will be delayed when storms occur to prevent overflow and back up of the downstream basins.

Accordingly, there are installed vortex flow regulators of one form or another within the various catch basins 21 of the system in their drain outlet pipes 28 and as indicated at 30 for the one form of the invention to automatically limit any increase of storm water flow from the basin 21. The present flow regulator and the other forms to follow have been constructed in a manner such that they can be standardized for production permitting lessening of costs and the establishing of a full sewer system with vortex flow regulators.

It has been found that the general design of the main body can be kept for given size range of performance and the only given need has been to provide a construction in which the size of the discharge orifice of regulator may be altered or changed.

Figure 15:
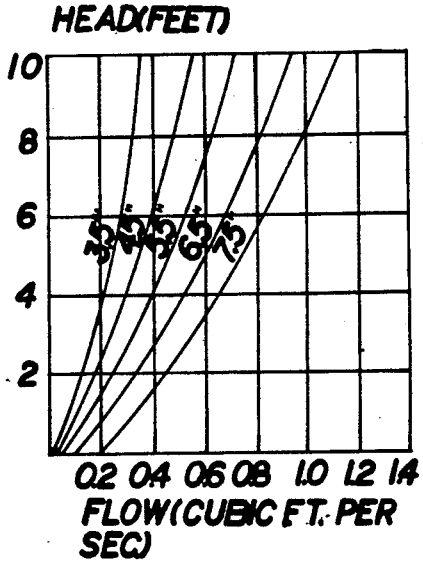
FIG. 15 is a chart from which the size of orifice for a given head and desired water flow can be readily determined.
Figure 4:
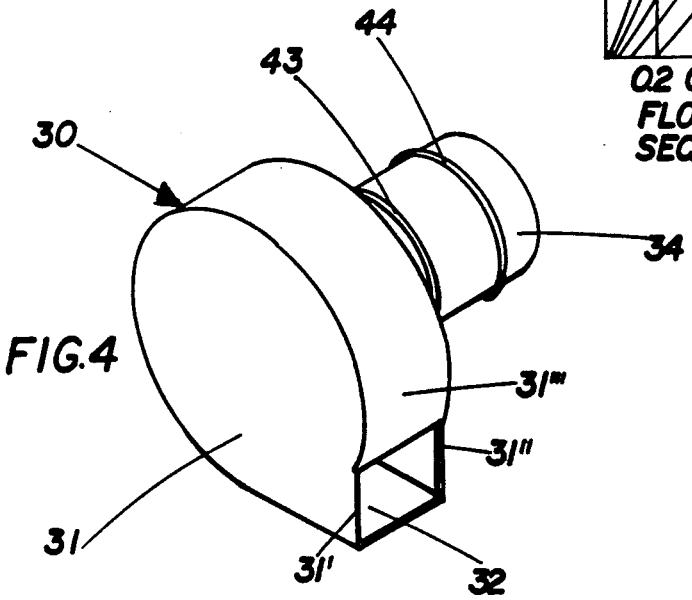
FIG. 4 is a perspective view of the vortex flow regulator of FIG. 1 removed from the catch basin.
Figure 8:
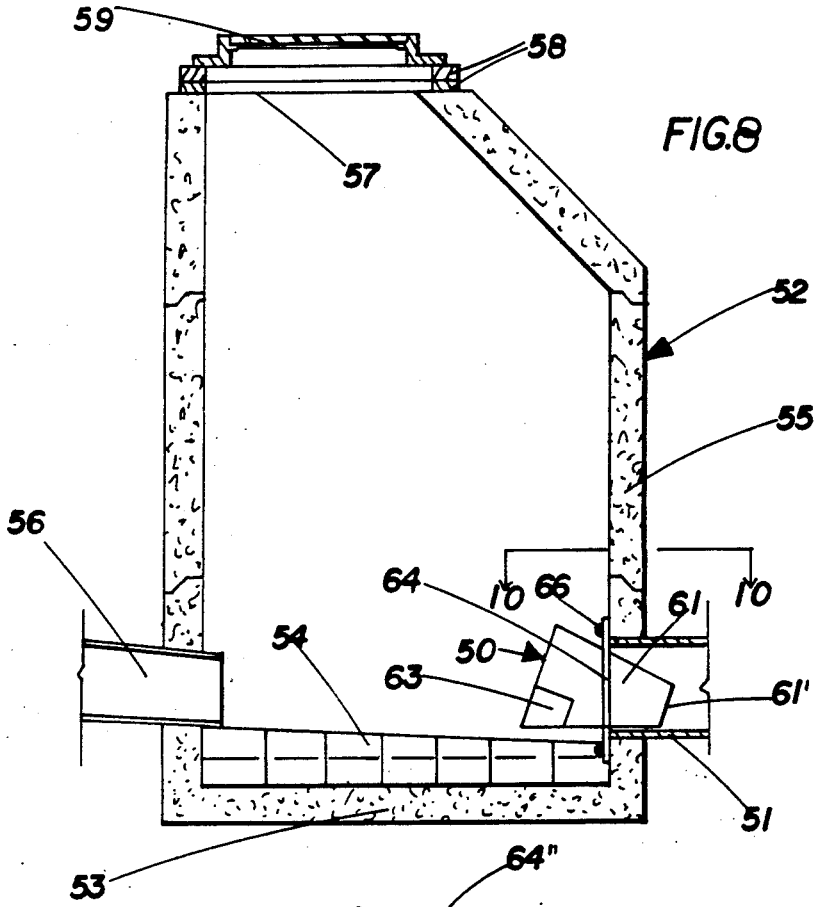
FIG. 8 is a fragment of a vertical sectional view of a sanitary or storm sewer manhole with a tapered and modified form vortex flow regulator embodying features of the present invention.
Figure 9:
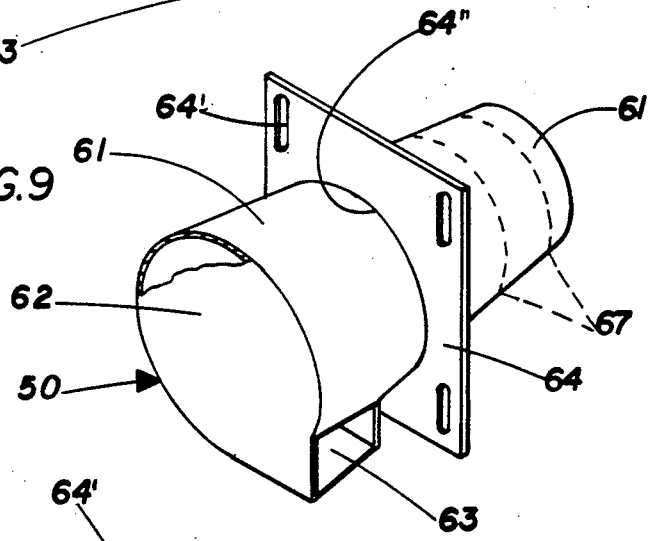
FIG. 9 is a perspective view of the flow regulator of FIG. 8 pulled from the catch basin drain pipes and broken away to show interior construction of the hollow body and phantom lines indicating places where cuts for the different size discharge orifices may be made.
Figure 11:
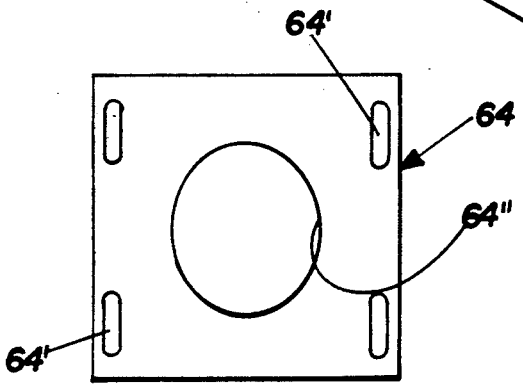
Figure 10:
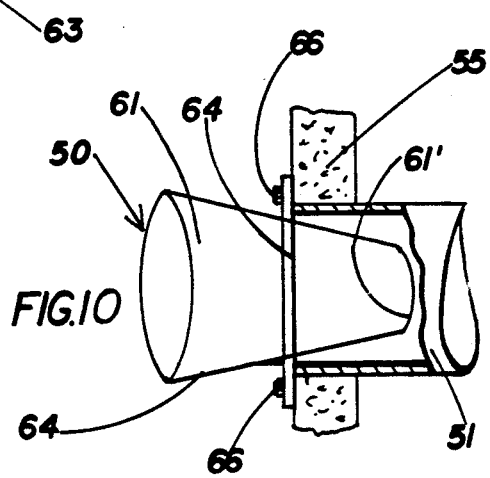
FIG. 10 is a fragmentary transverse sectional view of the basin of FIG. 8 as viewed on line 10—10 of FIG. 8 and with portions of the wall and drain pipe broken away to look in plan upon the flow regulator thereof.

By equation or by reference to the chart shown in FIG. 15 the diameter size in inches of the discharge orifice is readily acertained. The principal feature of the invention has been directed to a construction in which parts for the orifice of the regulator can be varied without need for re-building of an entire regulator. In so doing, a simple attaching means has been provided for the installation of the regulator within the basin drain pipe 28.

This flow regulator 30 comprises a main housing 31 that has a tangential inlet 32, a replaceable orifice disc 33 and releasable means for securing the orifice disc to the hollow body 31 that includes a flanged discharge pipe 34 by which the flow regulator 30 is tight fitted into the basin drain pipe 28 and mounted in the basins 21. The housing 31 will be standard for a given range of performance and is formed of cut parts of metal stock plate into shaped pieces, that are sized and welded together. The housing is generally circular except for the provision of the tangential inlet 32. Laterally-spaced end plate pieces 31' and 31" are separated and welded to an interposed spiral-shaped piece 31'" the lower ends of which are squared to provide the tangential inlet 32. The plate piece 31", has a large oversized opening 37 through which the storm water is discharged from its spiral path and through the sized orifice 33' of the replaceable disc 33 opening 34' of flanged discharge pipe 34 with flange 34'' and basin outlet drain pipe 28.

Projecting from the plate piece 31'' of the standard body 31 are six rigidly-connected stud bolts 38 equally and angularly spaced apart upon which the sized orifice disc 33 by its corresponding holes 33'' is mounted. For a different size orifice, the disc 33 can be replaced with a disc 40 having a larger orifice 40' and to corresponding bolt holes 40'' as shown in FIG. 7. Any number of different sized orifice discs can be provided and picked from the chart of FIG. 15. There can be one disc for each of the lines displayed on the chart.

The discharge pipe 34 has a flange 34' that matches with a shouldered opening 35' of a large retaining ring 35 also with holes 35' for receiving the stud bolts 38 on the standard body 31 and by use of nuts 42 the assembly with the orifice disc 33 will be made rigid and the flow regulator 30 readied to be fitted as a unit into the basin drain pipe 28. Comprehensible o-rings 43 and 44 make for water tight connection of the discharge 34 with the basin drain pipe 28. Should it be found that the orifice disc 33 does not work for the system, the regulator can be pulled and disc replaced with another disc that may seem better suited for the system without installation of a fully new regulator.

Some storm water is retained in the catch basin 21 at all times but as the water head increases above the flow regulator 30, water will enter the tangential inlet 32 and spiral within the body 31 at a rate depending upon the head of accummulated water and discharge through the centrally-aligned orifices 37 and 33' at the desired rate to hold back the discharge of water into the sewer system. The storm flow from the basin has thereby been curtailed and braked. With normal low head, flow is gentle and unobstructed. An increasing head of water will set the regulator in operation to limit the spill into the sewer system.

Referring now to FIGS. 8, 9, 10 and 11, there is shown a structural modification by which an orifice change can be made without a complete re-design of the regulator. It is a funnel-shaped type that is standard in size to cover a certain range of performance and as generally indicated at 50. This regulator has a taper of some 30 degrees through its central axis and when installed lays on its side with its small end extended into drain pipe 51 of a manhole or catch basin 52, adjacent to basin bottom 53 and bottom layers of bricks 54. Drain pipe 51 is within basin concrete wall 55 and opposite from a sewage inlet pipe 56. Storm water is delivered to the basin 52 through opening 57 enclosed by top rings 58 and a grated cover 59.

This flow regulator 50 comprises a conical or funnel-shaped shell 61 closed at its large end by sheet plate 62 welded thereto, and these parts are shaped to provide a tangential inlet 63 and at the small end, a measurable discharge outlet 61' for the flow of sewage and storm into the basin drain pipe 51. Intermediate the length of the funnel piece 61, there is welded a square-shaped mounting plate 64 and by the use of lag bolts or screws 66 passed through vertically-elongated holes 64' in the respective corners of the plate regulator 50 is secured in place to the basin wall 55 and within the drain pipe 51.

In order that the square mounting plate 64 will retain the flow regulator on its side and be perpendicular thereto and lie flush upon the wall 55, a special elongated elliptical cut 64'' is made in the plate 64 vertically to so accommodate the funnel shape 61 and to permit the continuous welding of the plate 64 thereabout. With the use of the plate 64 and the lag screws 66, the regulator 50 is rigidly retained on the basin wall 55 with the discharge end in the basin drain pipe 51.

With the desired water flow and the basin head in feet is known, it is an easy matter to refer to the chart in FIG. 15 to ascertain from the curves on the chart the diameter of orifice in inches that is needed for the proper performance of the particular basin in the overall sewer system.

With the orifice size having been determined the tapered small discharge end of the regulator may be cut as on any of dotted lines 67 to provide the sized discharge outlet for the regulator. The sludge and water entering inlet 63 is spiralled through the regulator and the discharge orifice 61' and into drain pipe 51 with delayed action as has been described in connection with the first form of the invention.

In FIGS. 13 and 14, there is shown still another form of the invention in which a regulator 70 itself is designed the same as the funnel-shaped regulator 50 just described and for use in a basin 72 except that a sleeve type slide-fitted attaching structure indicated at 73 and as shown in FIG. 14, which when assembled upon the regulator 70 will serve as a slide-fitting attachment for installation of the regulator into basin drain pipe 74 in side wall 76 of the basin 72. The basin 72 has a bottom section 77 from which drain pipe 74 extends and opposite thereto is an inlet pipe 78 and at the top of the basin is a usual storm water grate assembly 79. Bricks 81 overlie the bottom of the basin 72.

The regulator 70 includes a hollow-body 82 of funnel shape with a tangential inlet 83 and a tapered central discharge outlet 84. The funnel-shaped body 82 lies on its side over the bricks 81 and is supported and tightly fitted in the drain pipe 74 by its sleeve type slide-fitted attaching structure 73. This attaching structure 73 includes a tight fitting sleeve 86 and a plate 87 welded in one end thereof that has an elongated vertically-extending oval hole 87' to receive the tapered body in position for lying on its side, FIG. 4. These parts 82, 86 and 87 are welded to one another to provide for a rigid attaching structure 73. When the flow regulator 70 is installed in the drain 74, rubber O-rings 88 about the attaching structure 73 will make for an easy insertion into the drain pipe 74 and ensure that it is water tight-fitted.

It is to be understood that the tapered small end of the hollow body 82 will have been cut to the diametrical size ascertained from the chart in FIG. 15 for a given individual basin of a system of basins to render it suitable therewith. Their calculation will have been made on study of the system under storm conditions. Given the head in feet of the water in the basin above the installed flow regulator when the basin is filled and the permissible flow in cubic feet per second that the basin need to discharge, a regulator with proper discharge will have been provided. A coefficient of discharge will have been determined from trial and experimentation with the systems and used in the calculations providing for the chart so that discharge orifice size can be found speedily and the flow regulation fabricated from a standard hollow body.

Since there has been found a way by which a standard flow regulation body can be altered for different discharge rates without complete fabrication of regulators and use of standard dimension regulator body, the cost of equipping entire sewer systems will be greatly reduced and more systems can be fortified against storm water overflow. Catch basin flow regulators can be procured at less cost.

By use of such chart as shown in FIG. 15, orifice size for a given installation is readily determinable. The chart need only to be read. Say for a six foot head and a flow of a 4 cubic feet per second is desired, a 4.5 inch diameter orifice taken from one of the curves will have been learned. Such a size orifice need only to be provided in the manner set forth above upon a standard body and a completed flow regulator is made ready for installation within a storm water catch basin.

While various changes may be made in detail construction, it shall be understood that such changes shall be within the spirit and people of the present invention as defined in the appending claims.

What is claimed is:

1. A vortex water flow regulator adapted for use in a storm water catch basin having a horizonally-extending drain pipe comprising of a hollow tapered body with a discharge end that has been cut to provide an orifice sized to the individual basin requirements in a given storm sewer system, said tapered body having a tangential inlet to create a centrifugal whirl of storm water entering the tapered body from the catch basin to lengthen the time of passage of water therethrough in response to the water head within the basin, and a mounting plate having an oval opening through which the tapered body is extended and secured about its periphery for the tapered body to be retained on its side in the drain pipe with its axis angled from the horizontal axis of the drain pipe so that the tapered body will rest upon its side within the drain pipe and means for releasably securing the oval-orificed mounting plate to retain the tapered body in the drain pipe against axial displacement therefrom.

2. A vortex water flow regulator adapted for use in a storm water catch basin having a horizontally-extending drain pipe as defined in claim 1 and said mounting plate securing means being a slide-fitted attaching sleeve with sealing rings thereon for sealing engagement with the drain pipe.

3. A vortex water flow regulator adapted for use with storm water catch basins and manholes as defined in claim 1 chart for ascertaining correct diameter size in inches of a discharge outlet to be used from a given individual basin with a storm sewer system.

* * * * *